US009708756B2

(12) United States Patent
Baek

(10) Patent No.: US 9,708,756 B2
(45) Date of Patent: Jul. 18, 2017

(54) METHOD FOR MANUFACTURING A REINFORCED FABRIC FOR SUSTITUTION OF VINYL

(71) Applicant: Geon Yong Baek, Paju-si (KR)

(72) Inventor: Geon Yong Baek, Paju-si (KR)

( * ) Notice: Subject to any disclaimer, the term of this patent is extended or adjusted under 35 U.S.C. 154(b) by 486 days.

(21) Appl. No.: 14/156,841

(22) Filed: Jan. 16, 2014

(65) Prior Publication Data

US 2014/0366344 A1 Dec. 18, 2014

(30) Foreign Application Priority Data

Jun. 17, 2013 (KR) ..... 10-2013-0068925

(51) Int. Cl.

| | |
|---|---|
| ***D06M 15/53*** | (2006.01) |
| ***D03D 15/00*** | (2006.01) |
| ***D03D 37/00*** | (2006.01) |
| ***D06B 1/00*** | (2006.01) |
| ***D06C 3/00*** | (2006.01) |
| ***D01D 5/42*** | (2006.01) |
| ***D01F 6/04*** | (2006.01) |
| ***D03D 1/00*** | (2006.01) |
| ***D03D 3/02*** | (2006.01) |
| ***D03D 13/00*** | (2006.01) |
| *D01F 1/10* | (2006.01) |

(52) U.S. Cl.

CPC ..... *D06M 15/53* (2013.01); *D01D 5/426* (2013.01); *D01F 6/04* (2013.01); *D03D 1/00* (2013.01); *D03D 3/02* (2013.01); *D03D 13/008* (2013.01); *D03D 15/00* (2013.01); *D03D 37/00* (2013.01); *D06B 1/00* (2013.01); *D06C 3/00* (2013.01); *D01F 1/106* (2013.01); *D10B 2321/0211* (2013.01)

(58) Field of Classification Search

None

See application file for complete search history.

(56) References Cited

FOREIGN PATENT DOCUMENTS

KR 1010686410000 9/2011

*Primary Examiner* — Benjamin Schiffman

(74) *Attorney, Agent, or Firm* — IPLA P.A.; James E. Bame

(57) ABSTRACT

Provided are a reinforced fabric for substitution of vinyl and its manufacturing method which comprises a process (s1)) in which a HDPE and a UV reinforcing agent are mixed and liquefied and processed into a film; a thread manufacture process (s2); an elongation-cooling process (s3); a weaving process (s4); an original tissue recovery process; a LDPE-UV mixing liquid coating process; and a cutting or linking process (s7). The reinforced fabric for substitution of vinyl manufactured through the above described processes has an enhanced resistance with respect to durability and temperature and moisture, so the service life can be prolonged.

2 Claims, 1 Drawing Sheet

METHOD FOR MANUFACTURING A REINFORCED FABRIC FOR SUSTITUTION OF VINYL

CROSS REFERENCE

This application claims foreign priority under Paris Convention to Korean Patent Application No. 10-2013-0068925, filed 17 Jun. 2013, with the Korean Intellectual Property Office.

BACKGROUND OF THE INVENTION

The present invention relates to a reinforced fabric for substitution of vinyl and its manufacturing method, and in particular to a reinforced fabric for substitution of vinyl and its manufacturing method which has features in that in a first manufacture process, 100% virgin HDPE (High Density Polyethylene) and a UV reinforcing agent mixture are added in a reeling machine and are processed into a film material with a constant thickness, and the film processed past a cooling process is forced to pass over a roller equipped with a plurality of blades the intervals of which are adjustable, for hereby manufacturing threads which will be used as warp and weft. The threads whose durability are much reinforced through the elongation and cooling process are wound on a thread spool and are moved to a circular loom. The threads which were moved to the circular loom are used as a warp and a weft of the fabric for thereby manufacturing a first woven fabric cloth which is a basic material of the fabric. The first woven fabric cloth manufactured by the circular loom are formed in a tube shape one side of which is closed, so the closed one side of the tube shape is forced to open by a heat cutter and is processed into a flat fabric and is forced to pass over a certain triangle structure so as to recover a tangled weaving tissue into an original state. Afterward, the basic weaving tissue is moved to a coating line and is mixed at a certain ration with LDPE (Low Density Polyethylene) and UV reinforcing agent, and the mixed material is liquefied. Either side or one side of the first woven fabric cloth is uniformly coated or plated, for thereby manufacturing a fabric whose durability against UV is enhanced, and the fabric may be cut or linked to each other for its specific usage.

In case of visible vinyl or industry vinyl which are used for a facility such as a vinyl house, a cow house, a stable, a warehouse, a drying house, a flower garden, exercise, etc. and a fishing place, a garage, etc., its light transmissivity is high but very weak against strong wind, hail, heavy snow, typhoon, etc. and its durability is very low, so a user suffers economically since it needs to repeatedly replace once it is damaged. In case of an ordinary vinyl, it is hard to easily block UV, so the ordinary vinyl may affect indoor workers or growing plants due to over exposure to HV. In order to improve such problems, it urgently needs to develop a reinforced vinyl product for the use in agricultural and industrial sections, which makes it possible to keep in maximum the light transmissivity and prolong life service while reducing the costs of the uses of the vinyl products and keeping a user's health.

The patent application of No. 10-2009-0030631 is directed to a method for manufacturing a fiber-reinforced heating sheet for agricultural and industrial sections, more specifically to a fiber-reinforced heating sheet for agricultural and industrial sections of a double structure and its manufacture method, of which fiber-reinforced heating sheet comprises a back film for the substitution of a conventional vinyl, and a net mesh-shaped woven fabric cloth and a liner film, which seems to be similar with the present invention, but the present invention is directed to a fabric weaving method using a UV reinforcing agent addition, an elongation-cooling process and a circular loom and its manufacture method. The present invention provides enhanced durability and prolonged service life.

In particular, according to a conventional thread manufacture, an elongation process is necessary so as to elongate the thread as long as desired length; however when the thusly manufactured product is exposed to the sun, the product contracts. So as to improve the above mentioned problems, some additional processes are required. The ordinary weaving loom weaves weft using water; however the present invention is directed to manufacturing a product using a fabric which does not hold moisture in its basic weaving tissues. The present invention is directed to a reinforced fabric for substitution of vinyl and its manufacturing method which make it possible to enhance durability and prolong service life in such a way to reduce in maximum the evaporation of moisture in the tissues and any transformation of the fabric which may happen due to expansion in the middle of actual use.

SUMMARY OF THE INVENTION

Accordingly, it is an object of the present invention to provide a reinforced fabric for substitution of vinyl and its manufacturing method the product of which is not easily transformed against UV, weather, temperature and other use environments and has enhanced durability and increased light transmissivity.

It is another object of the present invention to provide a reinforced fabric for substitution of vinyl and its manufacturing method in the product of which the woven tissues of a cut portion don't collapse in the middle of the cutting of a fabric or a first woven fabric cloth.

It is further object of the present invention to provide a reinforced fabric for substitution of vinyl and its manufacturing method which make it possible to recover the shape of a tissue of a folded portion of a first woven fabric cloth to its original shape with the aid of a circular loom.

To achieve the above objects, there are provided a reinforced fabric for substitution of vinyl and its manufacturing method which have features in that HDPE (High Density Polyethylene) resin and UV reinforcing agent are mixed at a certain ratio, and a mixed material is liquefied and processed into a film with a certain thickness, and a film is cut into threads, and the LDPE and UV mixed resin is coated on either side of a fabric cloth woven using a circular loom for thereby enhancing durability against UV.

To achieve the above objects, there are provided a reinforced fabric for substitution of vinyl and its manufacturing method which have features in that the numbers of warps and wefts used per inch can be reduced as compared with other fabric cloths of the same weight in such a way to increase the thickness of thread with the aid of increased Denier values, so light transmissivity can be increased depending on the use and object of the product while keeping a desired strength.

To achieve the above objects, there are provided a reinforced fabric for substitution of vinyl and its manufacturing method which have features in that any transformations of the threads can be reduced in maximum by repeatedly performing the elongation-cooling process at least three to six times with respect to the manufactured threads while enhancing the strength.

To achieve the above objects, there are provided a reinforced fabric for substitution of vinyl and its manufacturing method which have features in that a cylindrical woven fabric cloth manufactured using a circular loom comes out of the top of a circular loom, and the top of the fabric cloth is cut open with a heat cutter and is forced to pass around a triangle, more specifically, a cylindrical woven fabric cloth is forced to pass past a lower side of a triangle shaped structure whose length is longer than the diameter of the cylindrical woven fabric cloth, so either side of the fabric cloth can have strong tensional force, whereby the folded portions of a first woven fabric cloth and the warp and weft can uniformly spread in a flat shape.

To achieve the above objects, there are provided a reinforced fabric for substitution of vinyl and its manufacturing method which have features in that the cutting portions are melted with a high temperature heat cutter when cutting a woven fabric cloth or a first woven fabric cloth, so it is possible to prevent the collapse of a woven tissue at a cut portion.

The reinforced fabric for substitution of vinyl and its manufacturing method according to the present invention have advantageous features in that the UV reinforcing agent used in the middle of manufacture of film and fabric cloth helps prevent the damages of the products due to UV, and the threads (warp and weft) processed through the repeating elongation-cooling processes so as to enhance the strengths can be used when manufacturing a fabric cloth in more densely woven tissues, so it is possible to minimize the damages from strong wind, hail, heavy snow and rain, typhoon.

The present invention has further feature in that a first woven fabric cloth is woven without moisture contained in such a way to use a circular loom, so any transformation due to heat or moisture can be prevented while elongating service life.

The present invention is effective to protect a worker from UV in such a way to scatter sunshine since the product of the present invention is made from a woven type fabric cloth. Thanks to the use of the UV reinforcing agent, it is possible to reduce in maximum the aging, transformation, spoilage and strength weakness of the film, and the product of the present invention can be used for the substitution of the vinyl in agricultural and industrial sections.

In addition, the cylindrical woven fabric cloth manufactured with a circular loom according to the present invention comes out of the top of the circular loom, and the top of the fabric cloth is cut open with a heat cutter and is forced to pass around the triangle. More specifically, the cylindrical woven fabric cloth is forced to pass past the bottom of the triangle structure whose length is longer than the diameter of the cylindrical woven fabric cloth, so either side of the fabric cloth comes to have a strong tensional force, whereby the folded portions of the first woven fabric cloth, warp and weft can spread flat and uniform, and since the mixture formed by liquefying the LDPE and UV reinforcing agent is uniformly and efficiently coated or plated, so a uniform coating can be obtained.

In addition, it is possible to easily adjust, using a high temperature heat cutter, the size of a fabric cloth in such a way to cut into content sizes and link the fabric cloths using a high temperature roller so that the woven tissues of the fabric cloth don't collapse.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE INVENTION

Figure 1:
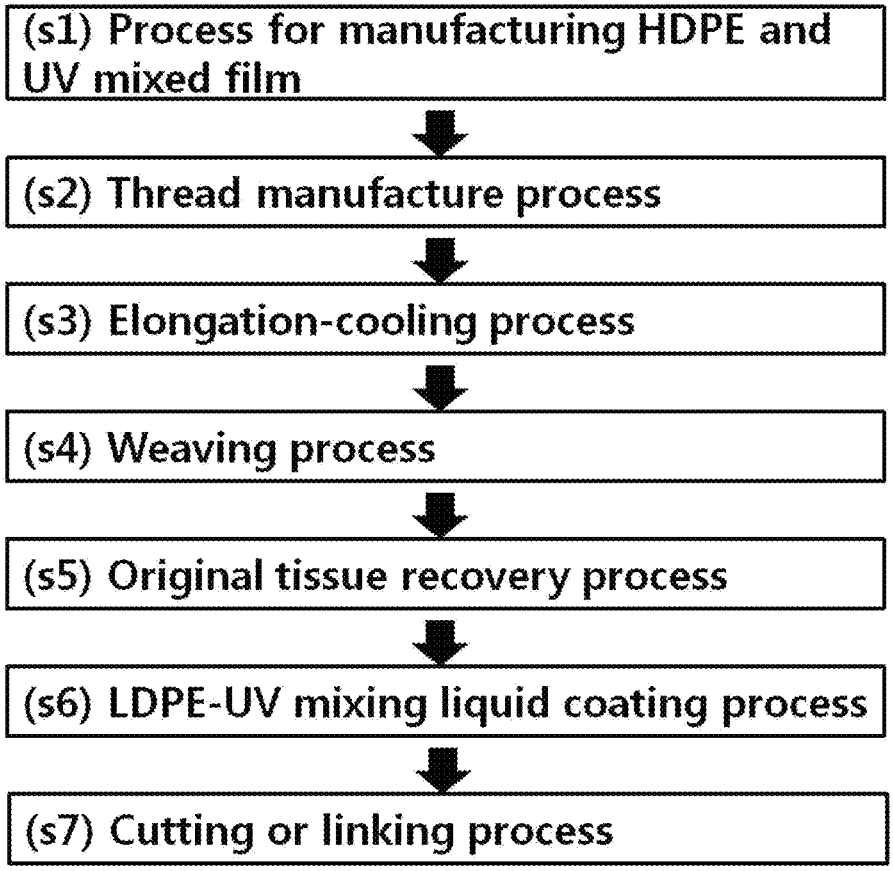
FIG. 1 is a flow chart of a method for manufacturing a reinforced fabric for substitution of vinyl according to the present invention.
Figure 2:
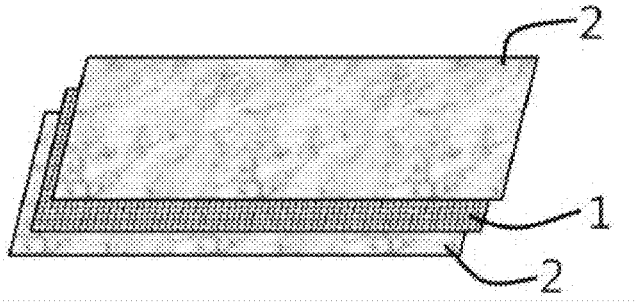
FIG. 2 is a view illustrating a construction of a reinforced fabric for substitution of vinyl according to the present invention.

The present invention is directed to a reinforced fabric for substitution of vinyl and its manufacturing method which comprises a process (s1)) in which a HDPE and a UV reinforcing agent are mixed and liquefied and processed into a film; a thread manufacture process (s2); an elongation-cooling process (s3); a weaving process (s4); an original tissue recovery process; a LDPE-UV mixing liquid coating process; and a cutting or linking process (s7). The reinforced fabric for substitution of vinyl manufactured through the above described processes has an enhanced resistance with respect to durability and temperature and moisture, so the service life can be prolonged.

More specifically, the process (s1)) for mixing and liquefying the HDPE and the UV reinforcing agent and processing into a film comprises a step in which a virgin HDPE (High Density Polyethylene) and a UV reinforcing agent are mixed at a weight % ratio of 80 to 99:1 to 20, and the mixed material is liquefied using a reeling machine and processed into a film.

(s2) In the thread manufacture process, the film manufactured in (s1)) is forced to pass over a roller equipped with 100 to 3,000 blades and is cut into pieces each with a width that a user wants.

(s3) In the elongation-cooling process, the threads manufactured in (s2) are repeatedly elongated and cooled 3 to 6 times for thereby enhancing the strength, durability and service life of the threads.

(s4) in the weaving process, the threads processed through the elongation-cooling process are used as warps and wefts and are processed using a circular loom into a fabric cloth of 25 g/sq. meter to 300 g/sq. meter, and the numbers of warps and wefts per inch (weave count/inch) are 3 to 20, and the thickness of the thread can be increased by increasing the denier values, and the light transmissivity and the strength of the product can be enhanced by reducing the numbers of the warps and wefts per inch based on the use and objects of the products.

(s5) In the original tissue recovery process, in the middle of opening one side of the first woven fabric cloth manufactured with a circular loom in a weaving process (s4), so as to recover the tissue of the folded portion of the fabric cloth to its original shape, the top of the cylindrical woven fabric cloth coming out of the top of the circular loom is cut open with a heat cutter, and is forced to pass past the lower side of the structure of the triangle whose length is longer than the diameter of the cylindrical woven fabric cloth, thus generating a tensional force of pulling the fabric cloth in all directions, so the folded portions of the first woven fabric cloth and warps and wefts can spread flat uniformly, whereby the woven fabric cloth can be recovered in a uniform and flat shape.

(s6) In the LDPE-UV mixed liquid coating process, on either side of the fabric cloth manufactured through the original tissue recovery process (s5) is coated, in a range of 5 g/sq. meter to 200 g/sq. meter, a mixture mixed with 80 to 90 weight % and 1 to 20 weight % of the UV reinforcing agent or 10 to 50 weight % of the whole weight of the fabric cloth is coated or plated for thereby reinforcing a resistance with respect to the UV and a strength of the fabric cloth.

(s7) In the cutting or linking process, a corresponding cut portion of the first woven fabric cloth or fabric cloth manufactured through (s3) or (s6) is melted and cut with a heat cutter, thus preventing the collapse of the woven tissues, and it is possible to supply to a customer a fabric cloth or a first woven fabric cloth with a certain size that a user wants, in such a way to use a way of precisely melting and bonding a fabric cloth using a high pressure and temperature roller.

In addition, in a process for mixing and liquefying HDPE and UV and processing into a film (s1), the virgin HDPE and UV reinforcing agent are mixed at a weight % ratio of 80 to 99:1 to 20 into a film, and a first woven fabric cloth of 25 g/sq. meter to 300 g/sq. meter is manufactured with a circular loom using the threads which were manufactured through the reinforced thread manufacture process in which the elongation and cooling are repeatedly performed. The reinforced fabric for substitution of vinyl according to the present invention comprises a first woven cloth the numbers of warps and wefts of which (weave count/inch) are 3 to 20 whose range can be adjusted based on the use and purpose; and a coating layer on either side or one side of which is coated or plated with 5 g/sq. meter to 200 g/sq. meter corresponding to 10 to 50% of the weight of the whole fabric cloth which was manufactured by mixing LDPE and UV reinforcing agent at a weight % ratio of 80 to 90:1 to 20 for thereby enhancing a resistance with respect to UV and the strength of the fabric cloth.

In addition, the present invention is directed to manufacturing a reinforced fabric for substitution of vinyl which comprises a first woven fabric cloth and a coating layer which are manufactured through the (s1)) to (s7).

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A method for manufacturing a reinforced fabric for substitution of vinyl, comprising:

(s1) a process for mixing and liquefying HDPE (High Density Polyethylene) and a UV (Ultraviolet Ray) enforcing agent and forming a film;

(s2) a thread manufacture process in which the film manufactured in (s1) is forced to pass over a roller equipped with 100 to 3,000 blades and is cut into threads;

(s3) an elongation-cooling process in which the elongating and cooling of the threads manufactured in (s2) is performed 3 to 6 times;

(s4) a weaving process in which the threads processed through the elongation-cooling process are woven by warps and wefts using a circular loom into a fabric cloth of 25 g/sq. meter to 300 g/sq. meter, and the numbers of warps and wefts per inch (weave count/inch) are 3 to 20, and the thickness of each of the threads can be increased by increasing denier values, and light transmissivity and strength of the fabric cloth can be enhanced by reducing the numbers of the warps and wefts per inch as compared with other fabric cloths with the same weight;

(s5) reinforcing process in which either side of the fabric cloth receives a strong tensional force while the fabric cloth passes around a lower side of a reinforcing triangle-shaped structure;

(s6) a LDPE (Low Density Polyethylene) agent coating process, wherein either side or one side of the fabric cloth is coated 5 g/sq, meter to 200 g/sq. meter; and (s7) a linking process in which portions of the fabric cloth manufactured in (s6) are precisely melted and inter-bonded using a heat cutter equipped with a high pressure and temperature roller.

2. The method of claim 1, wherein the mixing of the HDPE and the UV reinforcing agent is performed at a weight % ratio of between 80:20 and 99:1 without adding additional materials, and the mixed material is liquefied using a reeling machine and processed into a film.

* * * * *